US005455755A

United States Patent [19]

Bandy

[11] Patent Number: 5,455,755

[45] Date of Patent: Oct. 3, 1995

[54] LIGHT DISPLAY APPARATUS

[76] Inventor: Frank Bandy, 2351 Snug Harbor Dr., Palm Beach Gardens, Fla. 33410

[21] Appl. No.: 100,889

[22] Filed: Aug. 2, 1993

[51] Int. Cl.[6] ..... F21V 5/04; F21V 9/00

[52] U.S. Cl. ..... 362/284; 362/84; 362/223; 362/335; 362/806

[58] Field of Search ..... 362/32, 34, 35, 362/84, 289, 272, 278, 284, 286, 329, 806, 811, 223, 326, 335; 40/431, 543; 446/229, 175, 179

[56] References Cited

U.S. PATENT DOCUMENTS

| | | | |
|---|---|---|---|
| 2,146,856 | 2/1939 | Schulze-Alsen | 40/431 |
| 3,791,058 | 2/1974 | Mollica | 362/35 |
| 4,008,534 | 2/1977 | Swartz | 40/431 |
| 4,364,106 | 12/1982 | Lam | 362/806 |
| 4,858,088 | 8/1989 | Agabekov | 362/223 |
| 5,032,009 | 7/1991 | Chan | 446/175 |
| 5,291,674 | 3/1994 | Torrence | 446/179 |

OTHER PUBLICATIONS

Brochure produced by BWF Kunstoffe GmbH & Co. concerning light–collecting plastics.

*Primary Examiner*—James C. Yeung

*Assistant Examiner*—Y. Quach

*Attorney, Agent, or Firm*—Quarles & Brady

[57] ABSTRACT

An apparatus for creating a light display. The apparatus includes a display housing having at least one lens aperture and a light source for illuminating the interior of the housing with light having a specified wavelength. At least one light-collecting profile part capable of glowing when exposed to light of the specified wavelength is mounted within the display housing. A lens mounted in the lens aperture is provided for diffusing and scattering light associated with the light-collecting profile part. In an alternative embodiment, the invention provides an interactive light display toy for amusement. The toy includes a housing having a lens aperture and a canister aperture. A canister containing light-collecting profile parts is rotatably mounted at least partially within the housing. The canister has at least one side wall formed at least partially from a light-diffusing canister lens. A light source is provided for illuminating the interior portion of the canister, with light having a wavelength suitable for causing the profile parts to glow. A light-diffusing viewing lens rotatably mounted in the lens aperture allows light emitted through the canister lens by the light-collecting plastic profile parts to be scattered and diffused to create a pleasing viewing effect when the viewing lens and canister are rotated.

1 Claim, 3 Drawing Sheets

LIGHT DISPLAY APPARATUS

BACKGROUND OF THE INVENTION

Various types of devices exist for creating unusual lighting effects. Generally speaking, these devices use incandescent, fluorescent, neon or, in some cases, lasers as a light source. Such systems generally require movement of either the light source, the lenses associated with the light source, or both, in order to create an impression of flowing or otherwise moving light images.

In devices of the prior art, the need to move the light source or lenses associated therewith generally creates problems in terms of increased complexity and, therefore, increased cost. Furthermore, such devices are limited in achieving a desired lighting effect by the mechanical equipment necessary to create relative movement of lenses with respect to a light source in a manner which appears generally random and non-repetitive. In cases where the light source is moved relative to an observer or to a lens, additional complexity results from the need to provide electrical power to the moving light source. Various systems are available for providing electric power to a moving light source. However, such systems will generally tend to be unreliable and prone to failure as a result of the mechanical limitations of the electrical connections associated therewith.

A further problem associated with light display devices of the prior art relates to safety concerns with the lighting and electrical equipment used. For example, in light display systems which use neon lamps to achieve a lighting effect, extremely high voltages must be provided in order to cause the lamps to operate. These high voltages are not only a safety hazard for humans, but also result in increased cost in order to shield such systems from accidental contact with people. Finally, neon lamps also have significant drawbacks in that they tend to be delicate and subject to breakage upon impact. The glass tubing encasing a neon lamp in such cases will present a hazard to adults and children.

Laser light operated systems also present hazards to users. In the case of lasers, this hazard relates to the risk of eye injury associated with direct viewing of a laser beam. The intense laser light can potentially cause significant damage to an observer's eye if not properly diffused and shielded. Lasers present the further drawback of being relatively more expensive as compared to other types of lighting systems, and as such are less desirable for consumer use.

SUMMARY OF THE INVENTION

It is among the objects of the invention to reduce the cost to operate and manufacture a light display apparatus.

Another object is to provide a light display apparatus with improved safety features to avoid injury to children.

It is another object of the present invention to provide a diffused random light display capable of economically achieving random light effects.

It is a further object of the present invention to provide a safe interactive light toy for children.

These and other objects and advantages are obtained with the novel light display apparatus of the invention. The invention, according to one embodiment, includes a display housing having at least one lens aperture, and a light source for illuminating the interior of the housing with light having a specified wavelength. The device further includes at least one light-collecting profile part mounted within the display housing, and a lens mounted in the lens aperture for diffusing and scattering light emanating from the interior of the housing. By illuminating the interior of the display housing with light of the specified wavelength, the light-collecting profile mounted within the display is caused to intensely glow as a result of its characteristic light-collecting effect. The intensely glowing light-collecting profile part, when properly shaped and viewed through the diffusing and scattering lens, results in an attractive light pattern visible to an observer. The light-collecting profile parts are preferably movable within the housing so that the light effect, when viewed through the diffuser lens, appears to swirl and move in a pleasing, random pattern.

In an alternative embodiment of the invention, an interactive light toy is provided. The toy is comprised of a housing having a lens aperture and a canister aperture. A canister is rotatably mounted at least partially within the housing with one end of the canister extending through said canister aperture. At least a portion of at least one side wall of the canister is formed from a light-diffusing canister lens. In addition, a light source capable of emitting light of a specified wavelength is provided for illuminating an interior portion of the canister. A light-diffusing viewing lens is positioned in the lens aperture of said housing and permits a user to view the canister. Finally, light-collecting profile parts are enclosed within the interior portion of the canister. The light-collecting profile parts are made of a material which glows intensely when exposed to light emitted by the light source. Thus, by rotating the viewing lens and/or the canister with the profile parts contained therein, an entertaining, interactive light effect can be seen through the viewing lens for the amusement of children.

DESCRIPTION OF THE DRAWINGS

The attached drawings depict presently preferred embodiments of the invention. The drawings should not, however, be viewed as limiting the invention to the precise arrangements and instrumentalities shown, wherein.

DETAILED DESCRIPTION OF THE INVENTION

Figure 1:
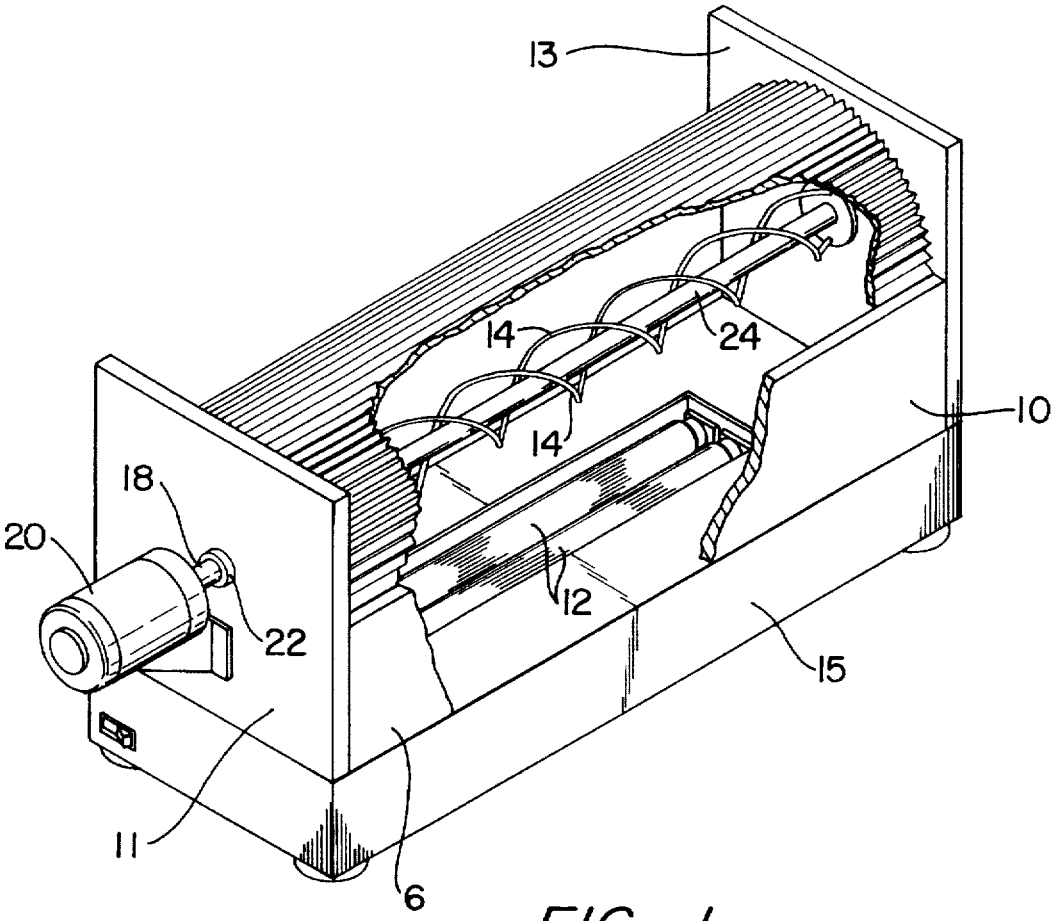
FIG. 1 shows a cut-away plan view of a light display apparatus according to a first embodiment of the present invention.
Figure 2:
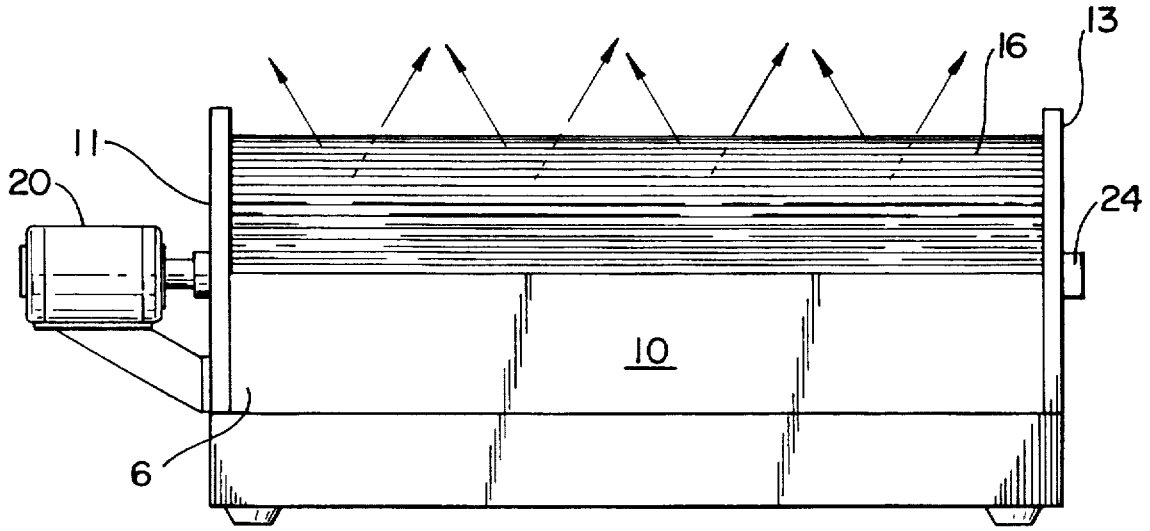
FIG. 2 shows a side view of a light display apparatus according to a first embodiment of the present invention.
Figure 3:
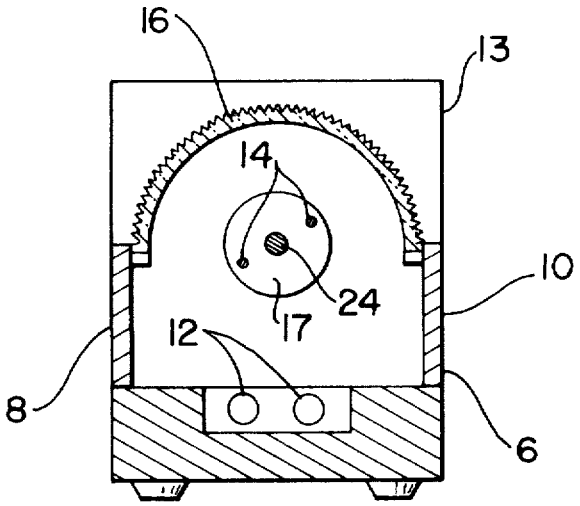
FIG. 3 shows a cross-sectional end view of a light display apparatus according to a first embodiment of the present invention.

FIGS. 1–3 show a light display apparatus according to one embodiment of the present invention. As shown in FIG. 1, the device includes a housing 10 for enclosing and supporting the various parts of the apparatus. Mounted within a base unit 15 of housing 10 is a light source 12. Light-collecting profile parts 14, which glow when illuminated by light having a specified wavelength, are mounted in an upper portion of the housing defined by side walls 6, 8 and end walls 11, 13.

The light-collecting plastic profile parts 14 are preferably mounted to means for moving said profile parts within said display housing to create a lighting effect which appears to move or flow when viewed through an appropriate lens. In the embodiment shown in FIG. 1, the profile parts are mounted to flanges 17 attached to each end of axle 18. In an alternative embodiment, however, said profile parts could be secured directly to axle 18. Axle 18 can be rotatably mounted in bearing apertures 22 and 24 formed in housing walls 11 and 13 respectively. An electric motor 20, which can be mounted on housing wall 11, is preferably provided to rotate axle 18, and thereby cause profile parts 14 to rotate within the housing. If an electric motor is used, a gear box (not shown) can be provided to reduce the speed of the electric motor.

It should be noted that while the embodiment of the invention shown in FIG. 1 discloses one method for mounting and moving the profile parts 14 within the display housing 10, the invention is not so limited. Any suitable means for positioning the profile parts within the housing in a movable manner will also work with the invention, so long as the profile parts can be simultaneously exposed to a suitable light source and viewed through an appropriate lens. For example, profile parts 14 could be placed upon a rotatable turntable within housing 10 or on a movable track illuminated by a light source mounted to the side of housing 10.

Light-collecting profile parts 14 used in connection with the invention are preferably formed from LISA brand light-collecting plastics available from Bayer AG, GEBW-1, D-51368 Leverkusen, Bayerwerk, Germany. However, any profile part capable of glowing intensely when exposed to light of a specified wavelength can be used for this purpose. If LISA brand profile parts are used, black light is preferably used to cause said profile parts to glow. The black light preferably has a wavelength of between 310 to 400 nanometers. Accordingly, light source 12 should be capable of emitting light in this range.

In the embodiment shown in FIG. 1, the profile parts 14 are helically shaped to wrap around axle 18. However, any shaped profile part can be used with the invention. Different shapes and colors will, of course, result in different lighting effects.

No specific power level is required for the light source 12. However, a more powerful light source will generally cause the profile parts to glow more intensely as compared to a lesser powered light source. Thus, the light source power level will generally depend upon design criteria relating to the brightness required from the profile parts, and the ambient light levels in the area where the device is to be used.

According to the invention, the profile parts are at least partially surrounded by a lens 16 for diffusing and scattering light collected in said light profile parts 14. As shown in FIGS. 1–3, the lens 16 is preferably translucent and can have a U-shaped profile along its length to facilitate maximum viewing of the lighting effect. Furthermore, as shown in FIG. 3, the lens 16 can be smooth on its inner surface facing profile parts 14 and can have parallel grooves on its outer surface for the purpose of diffusing and scattering light associated with the light-collecting profile parts 14.

FIGS. 1–3 show one possible type of translucent light-scattering lens for use with the invention. However, the invention is not so limited. Substantially, any lens capable of diffusing and scattering light associated with the light-collecting profile part 14 can be used with the invention, and different effects will be achieved depending upon the relative translucence and diffusing characteristics of the lens. The U-shaped lens 16 is convenient for use with the embodiment of the invention as shown in FIGS. 1–3. However, other lens shapes may also be used with the invention for differing results.

The inventive concept shown in FIGS. 1–3 can be applied for numerous purposes. For example, it can be used for decoration, illuminated advertising, architectural accenting, electrical appliances and equipment, exterior constructions as well as shop and fair equipment. Depending upon the application in which the invention is used, the precise form of the apparatus will vary. Nevertheless, the invention includes any such apparatus wherein the light-collecting profile parts are viewable through a translucent diffusing lens and illuminated by a light source of the necessary wavelength.

Figure 5:
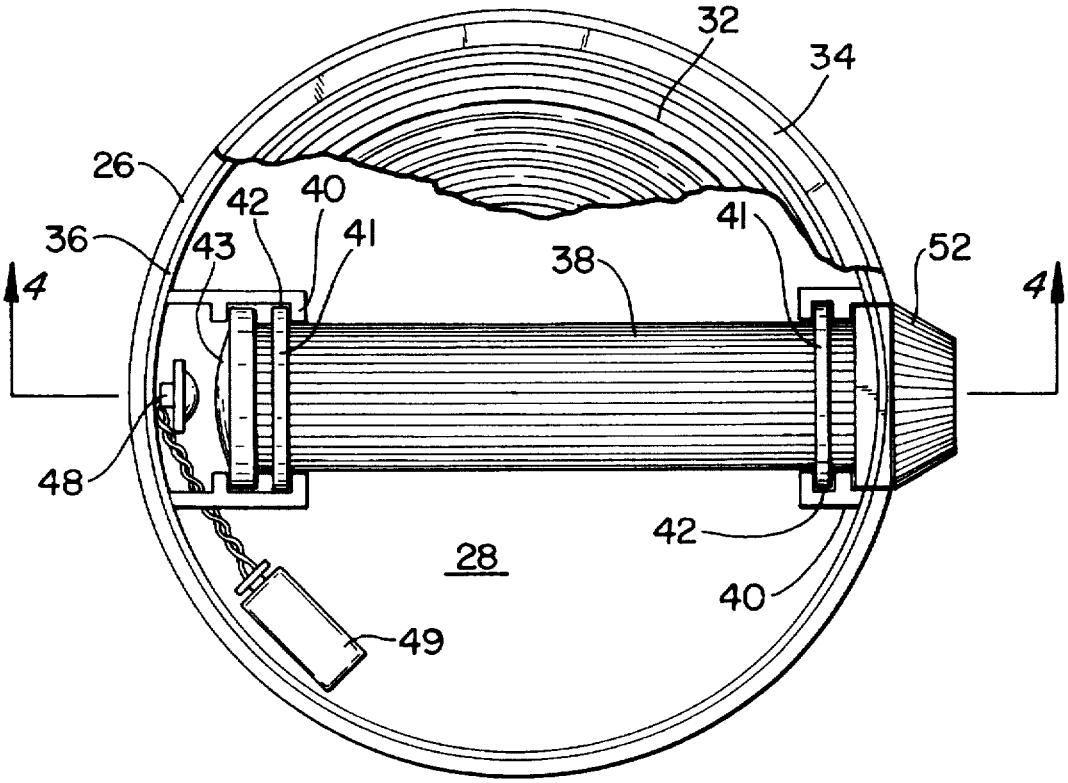
FIG. 5 shows a top view of an interactive light toy according to a second embodiment of the present invention.
Figure 4:
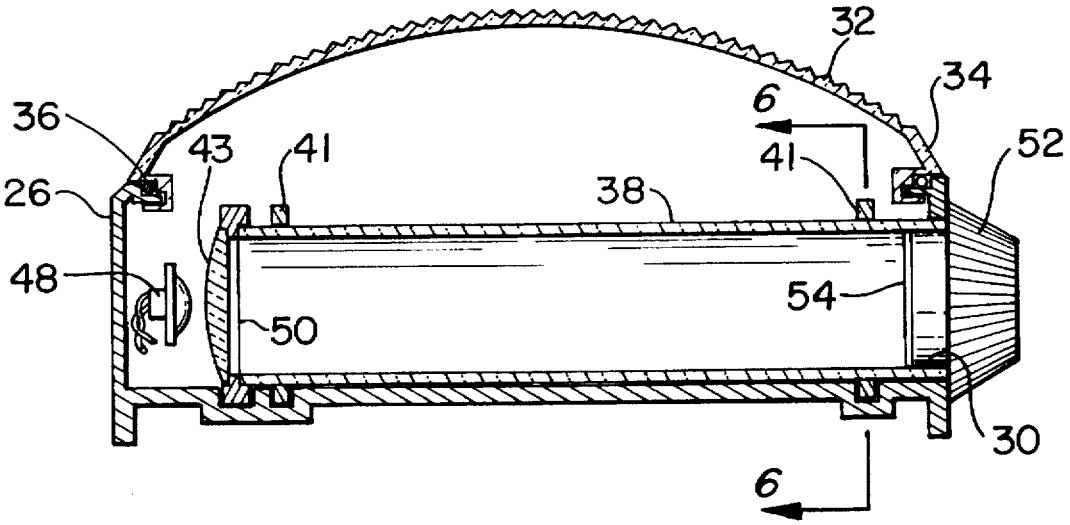
FIG. 4 shows a side view of an interactive light toy according to a second embodiment of the present invention.
Figure 6:
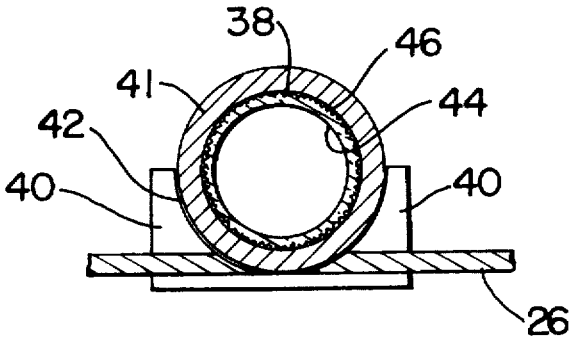
FIG. 6 shows a cut-away front view of an interactive light toy according to a second embodiment of the present invention.

In a second alternative embodiment of the invention, an interactive children's toy is disclosed. As shown in FIGS. 4–7, the interactive children's toy includes a housing 26 having a lens aperture 28 and a canister aperture 30. In FIGS. 4–6, the housing 26 is shown being of a roughly cylindrical form with the lens aperture 28 formed on an upper end face and the canister aperture 30 formed in a portion of the cylindrical side wall. Significantly, however, the invention is not so limited. The housing 26 may be formed in any suitable shape desired.

Figure 7:
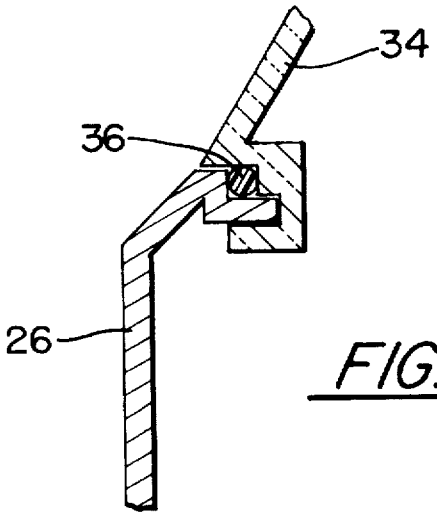
FIG. 7 shows a detail view of a lens ring in an interactive light toy according to a second embodiment of the present invention.

The device according to the present invention includes a viewing lens 32 rotatably mounted in lens aperture 28 of housing 26 by means of a lens ring 34. As shown in FIG. 7, lens ring 34 is fitted in aperture 28 of housing 26. Lens ring 34 has a grooved outer surface for gripping, and engages with friction-reducing O-ring bushing 36 which may be made from any suitable material such as nylon or teflon.

A canister 38, which may be cylindrically shaped, is rotatably mounted within the housing 26 by means such as support guides 40 which can be mounted to a lower portion of housing 26. If the canister 38 is cylindrically shaped, an upper portion of support guides 40 facing canister 38 can be profiled accommodate its cylindrical surface. In a preferred embodiment, a teflon bushing 42 is mounted to or integrally formed with the profile portion of support guides 40 to reduce friction between canister 38 and support guides 40 when canister 38 is rotated.

Canister 38 includes, along at least a portion of its length, a light-diffusing canister lens 44. The lens is preferably formed from a translucent material with grooves 46 extending parallel to the axis of canister 38 along its outer surface. However, any translucent lens capable of diffusing and scattering light emanating from within canister 38 can be used for this purpose. Different lenses will result in different interactive lighting effects. Consequently, in a preferred embodiment, lens 44 may be interchangeable with various types of translucent diffuser lenses.

Mounted within housing 26 is a light source 48. The light source 48 is capable of emitting light within a specified range of wavelengths for causing light-collecting profile parts to glow when exposed thereto. In a preferred embodiment, the light source 48 is mounted to a portion of housing 26 adjacent to a transparent canister end face 50. The light source 48 can be powered by an external source of electricity or by a battery 49 provided within housing 26. Housing 26 also preferably contains a lens 43 interposed between light source 48 and the interior of canister 38. In a preferred embodiment shown in FIG. 5, the lens 43 can be integrally formed with end face 50.

Surrounding canister 38 are annular canister-bearing supports 41. Canister-bearing supports 41 are preferably designed to engage in channels defined by support guides 40 so that canister 38 is prevented from being removed from housing 26 in the direction of canister aperture 30. Bearing supports 41 can include a self-lubricating teflon or nylon bearing surface interposed between the bearing supports 41 and the channels formed in support guides 40.

The canister support mechanism described with respect to FIGS. 5–6 represent one possible means for rotatably supporting canister 38. Significantly, however, the invention is not so limited. Any suitable structure for simultaneously guiding and supporting canister 38 can be used for this purpose.

On an opposite end of canister 38 from the transparent canister end face 50 is a removable end cap 52. Removable end cap 52 is provided with a reflective inner surface 54 to facilitate illumination of the interior of canister 38 by reflecting light from light source 48. Removable end cap 52 can be screwed onto the end of canister 38 or may be removably attached by means of an interlocking snap-fit connector. Alternatively, any suitable structure for removably fixing end cap 52 to canister 38 may be used for this purpose.

In a preferred embodiment, removable end cap 52 extends at least partially through canister aperture 30 formed in the housing 26. In this manner, end cap 52 can be conveniently removed by unscrewing or unsnapping it when necessary to provide access to the interior of canister 38. In addition, end cap 52 serves as a convenient gripping surface by which a user can manually rotate canister 38 within housing 26.

In FIGS. 4–6, light-collecting profile parts can be inserted into canister 38 by removal of canister end cap 52. The light-collecting profile parts are preferably formed from LISA brand light-collecting plastics available from Bayer AG, GEBW-1, D-51368, Leverkusen, Bayerwerk, Germany. If LISA brand profile parts are used with the invention, the light source is preferably capable of emitting black light in the range of 310 nanometers to 400 nanometers. Once again, however, any suitable light-collecting profile part may be used with the invention, provided such parts will glow when exposed to a source of light having a suitable wavelength.

To operate the above-described interactive toy, the user rotates canister 38 by gripping removable end cap 52 and preferably simultaneously rotating viewing lens 32. If light-collecting profile parts are inserted in canister 38, they will be caused to glow intensely when exposed to light source 48. The light emitted from said profile parts will be diffused and scattered by means of canister lens 44 and further diffused and scattered by viewing lens 32. The resulting light pattern or images appearing at viewing lens 32 can be multi-colored and constantly changing if the profile parts are allowed to tumble freely within the canister.

While the invention has been shown and described with respect to particular embodiments thereof, this is for the purpose of illustration rather than limitation, and other variations and modifications of the specific embodiments shown herein and described will be apparent to those skilled in the art. All such alternative embodiments are intended to be within the true spirit and scope of the invention. Accordingly, the patent is not to be limited in scope and effect to the specific embodiments herein shown and described.

I claim:

1. Apparatus for creating a light display comprising:

a display housing having at least one lens aperture, at least one light-collecting profile part mounted within said display housing, said light-collecting profile part capable of glowing when exposed to light of a specified wavelength, a light source mounted within said display housing for illuminating an interior of said housing with light having a wavelength suitable to cause said light collecting profile part to glow, a lens mounted in said at least one lens aperture for diffusing and scattering light associated with said light-collecting profile part, whereby a glowing pattern of light is caused to appear to an observer when said at least one light-collecting profile part is viewed through said lens, said at least one light-collecting profile part mounted to an axle rotatably mounted within said housing such that said glowing pattern of light appearing on said lens is caused to move across a surface of said lens when said light-collecting profile part is moved within the housing, and wherein said at least one light-collecting profile part includes an elongated light-collecting rod twisted around said axle and extending along at least a portion of a length of said axle.

* * * * *